US007076873B2

(12) United States Patent
Sugahara et al.

(10) Patent No.: US 7,076,873 B2
(45) Date of Patent: Jul. 18, 2006

(54) METHOD OF MANUFACTURING AN INK-JET HEAD

(75) Inventors: Hiroto Sugahara, Aichi-ken (JP); Masaaki Deguchi, Chiryu (JP); Atsushi Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/939,249

(22) Filed: Sep. 9, 2004

(65) Prior Publication Data

US 2005/0030351 A1 Feb. 10, 2005

Related U.S. Application Data

(62) Division of application No. 10/302,181, filed on Nov. 22, 2002, now abandoned.

(30) Foreign Application Priority Data

Nov. 30, 2001 (JP) ..... 2001-366194

(51) Int. Cl.
*B21D 53/76* (2006.01)
*B41J 2/045* (2006.01)

(52) U.S. Cl. ..... 29/890.1; 29/830; 29/831; 29/832; 29/835; 347/71

(58) Field of Classification Search ..... 29/890.1, 29/830, 831, 832, 835; 347/65, 71, 68; 216/27, 216/33, 72, 75, 100
See application file for complete search history.

(56) References Cited

U.S. PATENT DOCUMENTS 4,680,595 A * 7/1987 Cruz-Uribe et al. ..... 347/40
5,296,995 A * 3/1994 Yonezawa et al. ..... 360/135
5,940,099 A * 8/1999 Karlinski ..... 347/70

* cited by examiner

*Primary Examiner*—A. Dexter Tugbang
*Assistant Examiner*—Tai Nguyen
(74) *Attorney, Agent, or Firm*—Reed Smith LLP

(57) ABSTRACT

A cavity plate of an ink-jet head is formed by stacking a clad plate on a manifold plate. The clad plate is formed by unitarily bonding a first layer and a second layer, which are made of different materials. Pressure chambers and communicating holes to the pressure chambers are formed in the first and second layers, respectively. Each of the first and second layers is etched using an etching agent that is able to only one of the layers to form therein the pressure chambers or the communicating holes. Thus, the pressure chambers and the communicating holes are formed with high precision in depth. In addition, the cavity plate including the clad plate with a predetermined thickness is easy to handle when manufactured into an ink-jet head.

20 Claims, 14 Drawing Sheets

METHOD OF MANUFACTURING AN INK-JET HEAD

CROSS-REFERENCE TO RELATED APPLICATIONS

This is a division of U.S. application Ser. No. 10/302,181, filed Nov. 22, 2002 now abandoned, which claims priority to Japanese Application No. 2001-0366194, filed Nov. 30, 2001, all of which are incorporated herein by reference.

BACKGROUND OF THE INVENTION

1. Field of Invention

The invention relates to an ink-jet head and, more particularly, to an ink-jet head having a cavity plate including a clad plate. The invention also relates to a method of manufacturing such an ink-jet head.

2. Description of Related Art

An ink-jet printer having an ink-jet head is known as a recording device that records images on a recording medium, such as a sheet of paper. As shown in FIG. 13, an ink-jet head 150 of such an ink-jet printer includes a piezoelectric actuator plate 155 that extends and contracts by a drive voltage generated in a driving circuit (not shown), a cavity plate 156 formed with ink passages, and a nozzle plate 157 formed with ink ejecting nozzles 158 and made of synthetic resin, such as polyimide. The actuator plate 155, cavity plate 156, and nozzle plate 157 are vertically stacked so as to be placed at the top, in the middle, and at the bottom, respectively. Each plate 155–157 is a thin plate. The cavity plate 156 is formed by vertically stacking first, second, and third metal layers 156*a*–156*c*. Pressure chambers 165 are formed in the first layer 156*a* by etching so as to store ink therein. Ink is ejected from a selected pressure chamber 165 by the action of the actuator plate 155. A manifold 169 is formed in the third layer 156*c* by etching so as to supply ink to the pressure chambers 165. Communicating holes 167 are formed in the second layer 156*b* by etching such that each pressure chamber 165 communicates, at its one end, with the manifold 169. Further, communicating holes 168, 170 are formed in the second and third layers, respectively by etching such that each pressure chamber 165 communicates, at its other end, with the associated nozzle formed in the nozzle plate 157 through the associated communicating holes 168, 170. The manifold 169, pressure chambers 165, communicating holes 167, 168, 170, and nozzles 158 define ink passages.

The first and second layers 156*a*, 156*b* of the cavity plate 156 are as thin as about 20–80 μm and 20–120 μm, respectively. Thus, the cavity plate 156 is likely to bend or buckle when handled for manufacturing the ink-jet head 150, and the manufacturing yield is reduced. To solve such a problem, an ink-jet head 160 having a cavity plate formed by a first layer 166*a* and a second layer 166*b*, as shown in FIG. 14, is conceivable. The first layer 166*a* is made of a single material and formed to a predetermined thickness by unitarily combining the first and second layers 156*a*, 156*b* of the cavity plate 156 of FIG. 13. The second layer 166*b* corresponds to the third layer 156*c* of FIG. 13. In this case, the first layer 166*a* undergoes half-etching to form therein pressure chambers 175. Then, the first layer 166*a* is further etched to form therein communicating holes 177 through which the pressure chambers 175 communicate with a manifold 169 formed in the second layer 166*b*, and to form therein communicating holes 178 through which the pressure chambers 175 communicate with associated nozzles 158.

In the above-described ink-jet head 160, the pressure chambers 175 are formed in the first layer 166*a* by half-etching, that is, by etching the first layer 166*a* halfway in its material thickness. Thus, high precision in depth (in a vertical direction in FIG. 14) is difficult to achieve in the pressure chambers 175. As a result, the pressure chambers 175 have various and uneven depths, and the flow resistance varies among different pressure chambers 175, causing unstable ink ejection therefrom.

SUMMARY OF THE INVENTION

The invention addresses the forgoing problems and provides an ink-jet head having an easy-to-handle cavity plate formed with pressure chambers with high precision in depth. The invention also provides a method of manufacturing such an ink-jet head.

According to one aspect of the invention, an ink-jet head includes an actuator plate that is driven by a drive voltage generated in a driving circuit and a cavity plate including a clad plate formed by unitarily bonding first and second layers made of different materials. The first layer is laminated to the actuator plate and formed with pressure chambers from which ink is selectively ejected by an action of the actuator plate. The second layer is disposed on an opposite side of the first layer from the actuator plate and formed with first holes each communicating with an associated one of the pressure chambers. One of the first and second layers is made of metal able to be etched by a first etching agent while the other is made of a material substantially unaffected by the first etching agent. Either the pressure chambers in the first layer or the first holes in the second layer are formed by etching using the first etching agent.

According to another aspect of the invention, a method of manufacturing an ink-jet head, including an actuator plate driven by a drive voltage generated in a driving circuit and a cavity plate, is provided. An ink-jet head is manufactured by forming a clad plate of the cavity plate by unitarily bonding first and second layers made of different materials. One of the first and second layers of the clad plate is treated by etching using a first etching agent that is able to etch one of the first and second layers and substantially unable to etch the other to form either pressure chambers in the first layer or first holes in the second layer. The other of the first and second layers of the clad plate is treated to form the rest of the pressure chambers and the first holes such that each of the first holes communicate with an associated one of the pressure chambers. Then, the first layer of the clad plate is laminated to the actuator plate.

In another aspect of the invention, an ink-jet head comprising an actuator plate and a cavity plate is provided. The actuator plate is operable to be driven by a driving voltage. The cavity plate is attached to the actuator plate and includes a clad plate. The clad plate includes two layers that are unitarily bonded to each other. One layer contains pressure chambers from which ink is selectively ejected by an action of the actuator plate and the other layer bonded to the first layer contains communicating holes each communicating with an associated one of the pressure chambers. According to the invention, one layer of the clad plate is selectively etchable with respect to the other layer so that one etching agent can etch the pressure chambers in one layer without substantially affecting the other layer. Advantageously, the selectable etchability of one layer over the other produces accurate pressure chambers that are uniform in depth because half-etching steps of the prior art in forming the pressure chambers are avoided.

In another aspect of the invention, a method of manufacturing an ink-jet head including an actuator plate driven by a drive voltage and a cavity plate is provided. The method comprises unitarily bonding first and second layers made of different materials to form a clad plate of a cavity plate. One layer is etched using a first etching agent that is capable of selectively etching the one layer relative to the other layer to form either pressure chambers in the first layer or first holes in the second layer. The pressure chambers or the first holes in the other layer are formed such that each of the first holes in the second layer communicates with an associated one of the pressure chambers in the first layer. For example, one layer is etched using the first etching agent to form the pressure chambers without etching the other layer. The other layer is then etched using a different etching agent.

BRIEF DESCRIPTION OF THE DRAWINGS

Preferred embodiments of the invention will be described in detail with reference to the following figures, in which like elements are labeled with like numbers in which.

DETAILED DESCRIPTION OF PREFERRED EMBODIMENTS

Figure 1:
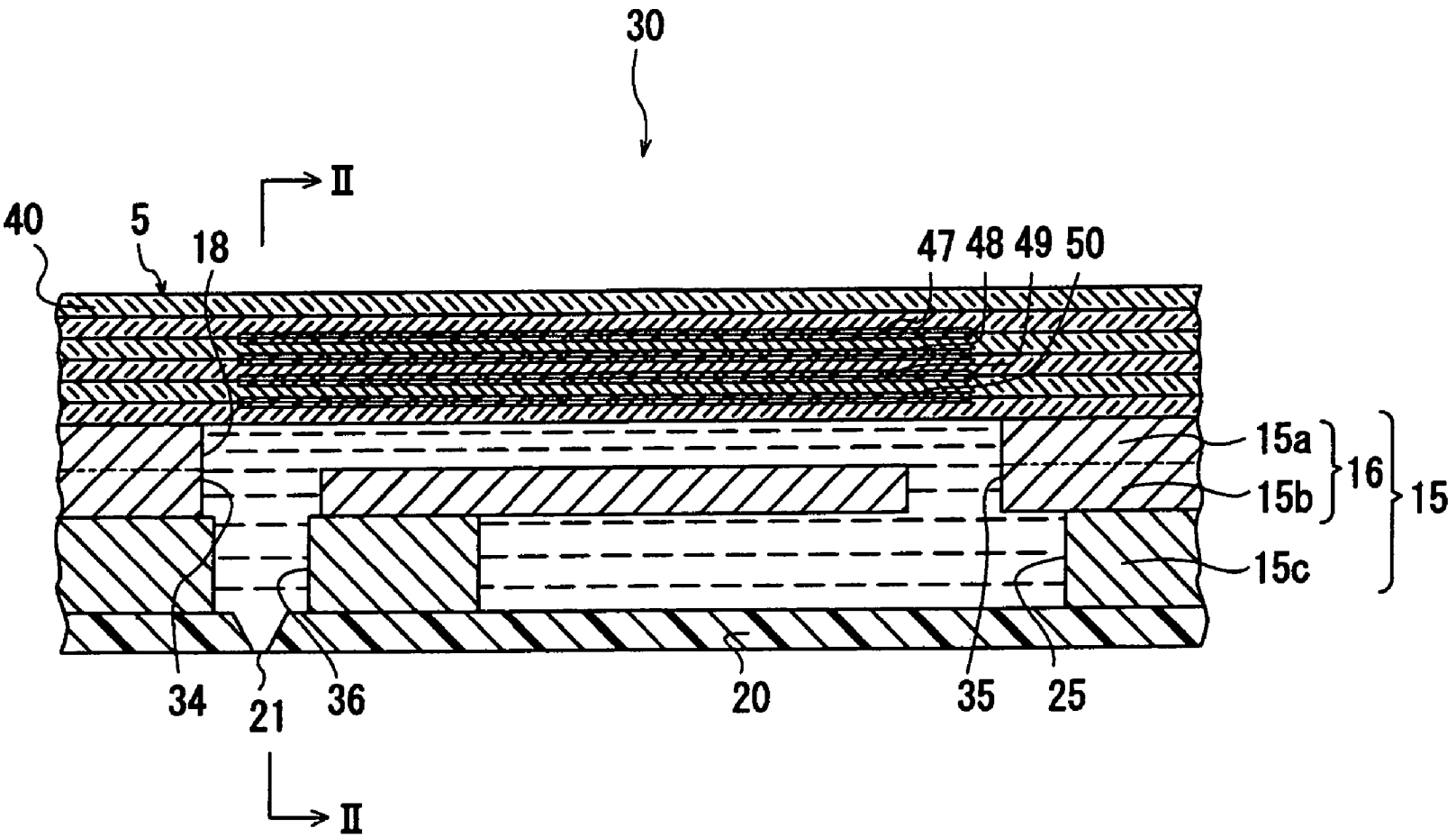
FIG. 1 is a cross-sectional view of an ink-jet head, according to a first embodiment of the invention, sectioned across a pressure chamber substantially parallel to its longitudinal direction.
Figure 2:
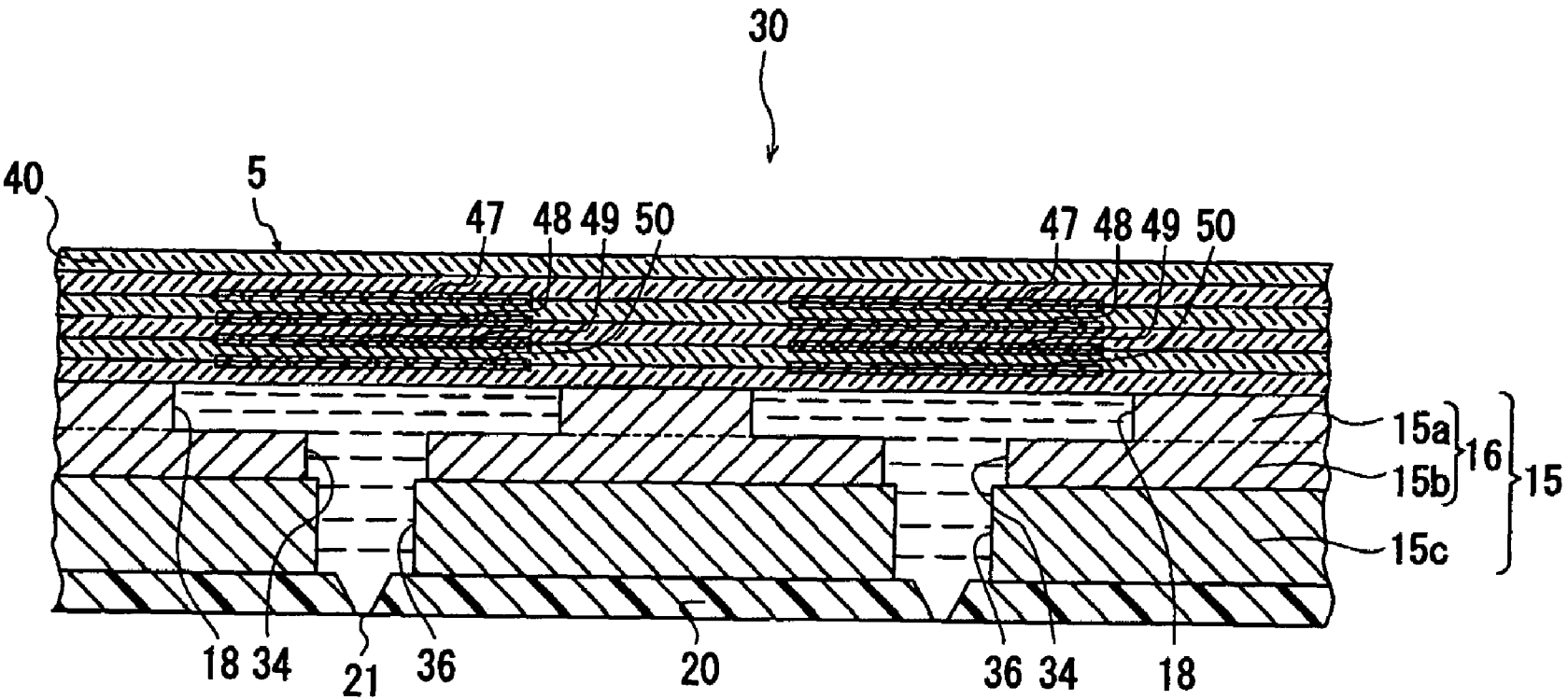
FIG. 2 is a cross-sectional view of the ink-jet head sectioned substantially parallel to an array of pressure chambers taken along line II—II of FIG. 1.

A first embodiment of the invention will be described with reference to the accompanying drawings. FIG. 1 is a cross-sectional view of an ink-jet head 30 sectioned across a pressure chamber substantially parallel to its longitudinal direction. FIG. 2 is a cross-sectional view of the ink jet head 30 sectioned substantially parallel to an array of pressure chambers taken along line II—II of FIG. 1. As shown in FIGS. 1 and 2, the ink-jet head 30 includes an actuator plate 5 driven by a drive voltage generated in a driving circuit (not shown), a cavity plate 15 in which ink passages are formed, and a nozzle plate 20 made of synthetic resin such as polyimide and formed with ink ejecting nozzles 21. The actuator plate 5, cavity plate 15, and nozzle plate 20 are vertically stacked so as to be placed at the top, in the middle, and at the bottom, respectively. The stacked plates 5, 15, 20 are bonded to each other using a thermosetting adhesive. To apply a drive voltage generated in the driving circuit (not shown) to the actuator plate 5, a flexible circuit board (not shown) or the like is bonded to the upper surface of the actuator plate 5. The ink-jet head 30 is constructed as described above.

The cavity plate 15 includes three thin metal layers 15*a*, 15*b*, 15*c*. A first layer 15*a*, a second layer 15*b*, and a manifold plate 15*c* are stacked from the top to the bottom, as shown in FIG. 1. The uppermost first layer 15*a* is in contact with the actuator plate 5 while the lowermost manifold plate 15*c* is in contact with the nozzle plate 20. The first and second layers 15*a*, 15*b* of the cavity plate 15 are made of different materials, and these two layers 15*a*, 15*b* are bonded to each other and unitarily rolled to a two-layer clad plate 16. The clad plate 16 has a thickness of about 40–200 μm. The materials of the first and second layers 15*a*, 15*b* will be described later.

A plurality of pressure chambers 18 are formed in the first layer 15*a* of the cavity plate 15 such that ink is stored therein and selectively ejected therefrom by the action of the actuator plate 5. The pressure chambers 18 are formed by etching the first layer 15*a* using an etching agent, and arranged across the plane of the first layer 15*a*, parallel to each other in their longitudinal directions. Communicating holes 34, 35 are formed in the second layer 15*b* by etching using an etching agent such that each pressure chamber 18 communicates, at its one end, with the associated nozzle 21 through the associated communicating hole 34 and, at its other end, with a manifold passage 25 through the associated communicating hole 35.

In addition, communicating holes 36 are formed in the manifold plate 15*c* such that each pressure chamber 18 communicates, at its the other end, with the associated nozzle 21 through the associated communicating hole 34. Further, the manifold passage 25 is formed extensively below and along an array of pressure chambers 18. As is well known, the manifold passage 25 is connected, at its one end, to an ink source and supplies ink to the pressure chambers 18 through the communicating holes 35. The manifold passage 25, communicating holes 35, pressure chambers 18, communicating holes 34, 36 and nozzles 21 form ink passages. Ink is supplied from the manifold passage 25 to the pressure chambers 18, and the ink in the pressure chambers is ejected therefrom through the nozzles 21. When the clad plate 16 has undergone etching, which will be described later, the manifold plate 15*c* is bonded to the clad plate 16 using a thermosetting adhesive.

The actuator plate 5 is made of piezoelectric ceramic, such as lead zirconate titanate (PZT) ceramic, and includes a plurality of piezoelectric ceramic layers 40 having a piezoelectric and electrostrictive effect and a plurality of inner electrodes 47, 48, 49, 50, each interposed between adjacent piezoelectric ceramic layers. The actuator plate 5 extends across all the pressure chambers 18, and each column of electrodes 47, 48, 49, 50 is placed over an associated one of the pressure chambers 18. Each portion sandwiched between adjacent inner electrodes 47, 48, 49, 50 is polarized by a well known technique and, upon the application of a voltage to adjacent inner electrodes in the same direction as the polarization direction, the sandwiched portion (active portion) extends in the laminating direction of the piezoelectric ceramic layers 40, thereby pressurizing ink in a selected pressure chamber 18 to cause ink ejection.

Figure 3:
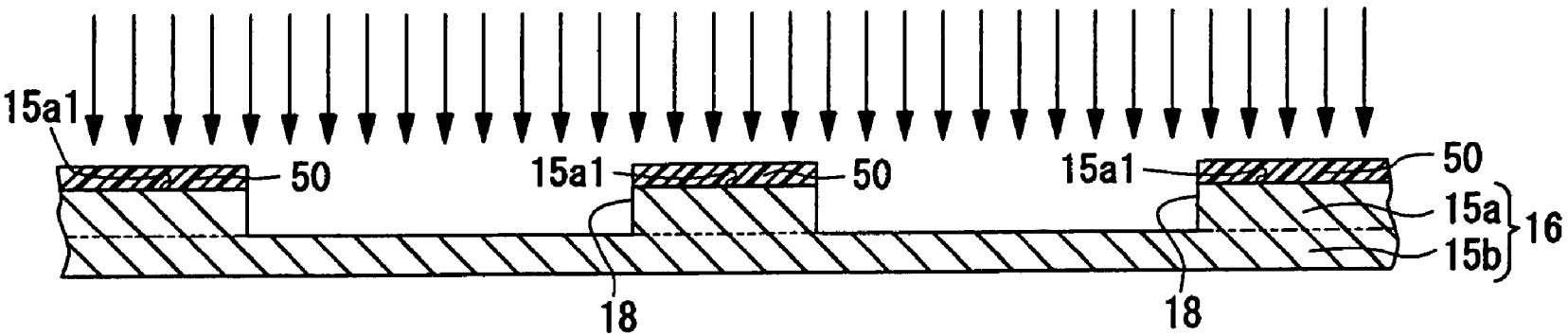
FIG. 3 is a cross-sectional view showing an etching process to form pressure chambers in a first layer of a clad plate.
Figure 4:
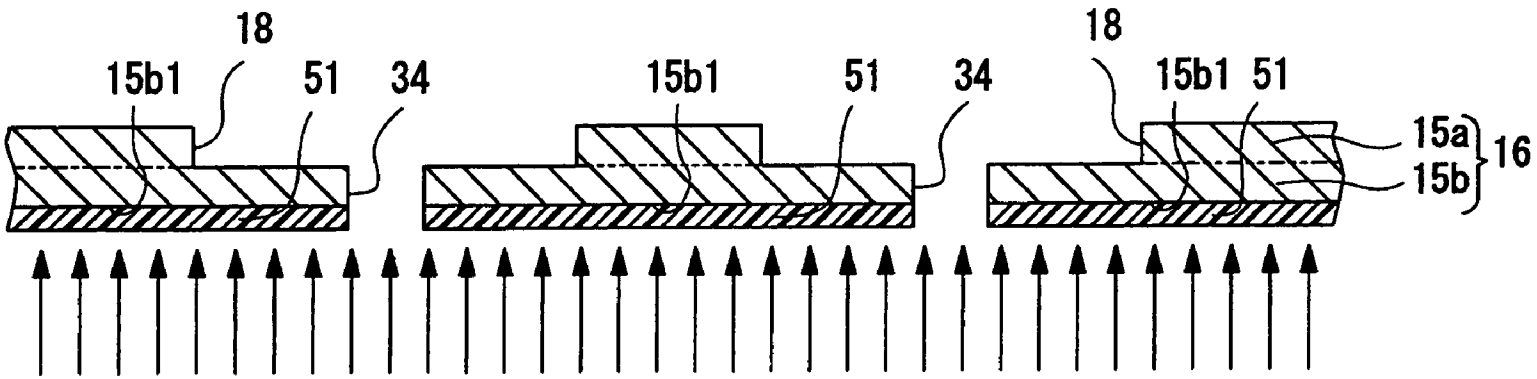
FIG. 4 is a cross-sectional view showing an etching process to form communicating holes in a second layer of the clad plate.

Referring now to FIGS. 3 and 4, a method of manufacturing the ink-jet head 30 will be described. Particularly, a method of manufacturing the cavity plate 15 will be described in detail. FIG. 3 is a cross-sectional view showing an etching process to form the pressure chambers 18 in the first layer 15*a* of the clad plate 16. The clad plate 16 is formed by the first and second layers 15*a*, 15*b* of the cavity plate 15. FIG. 4 is a cross-sectional view showing an etching process to form the through-holes 34 in the second layer 15*b* of the clad plate 16. As shown in FIG. 3, a resist 50 is formed first on the upper surface 15*a*1 of the first layer 15*a* of the clad plate 16 by spin coating, to cover those areas where no pressure chambers 18 are formed. In the spin coating, a resist is deposited on the upper surface 15*a*1 of the first layer 15*a* while the first layer 15*a* is rotated at high speed. The resist spreads over the upper surface 15*a*1 into a thin layer by the centrifugal force. Thereafter, an etching agent (not shown) that is able to etch only the first layer 15*a* and substantially unable to etch the second layer 15*b* is sprayed or dropped in the directions of the arrows downwardly toward the surface to be etched. In other words, the first layer 15*a* is selectively etchable with respect to the second layer 15*b*. As a result, only the first layer 15*a* is etched and the pressure chambers 18 are formed therein.

Then, as shown in FIG. 4, a resist 51 is formed on the lower surface 15*b*1 of the second layer 15*b* of the clad plate 16, in the same manner as that for forming the resist 50, to cover a portion where no communicating holes 34 are formed. Thereafter, an etching agent (not shown) that is able to etch only the second layer 15*b* and substantially unable to etch the first layer 15*a* is sprayed in the directions of the arrows upwardly toward the lower surface of the second layer 15*b*. As a result, only the second layer 15*b* is etched and the communicating holes 34 are formed therein. The communicating holes 35 can be formed in the second layer 15*b* in the same manner as for forming the communicating holes 34, simultaneously with the communicating holes 34. If the communicating holes 34, 35 are formed to be aligned with the associated pressure chambers 18 and the diameter of each communicating hole 34, 35 is formed to be equal to or smaller than the width (perpendicular to the longitudinal length) of the associated pressure chamber, an etching agent that is able to etch the second layer 15*b* as well as the first layer 15*a* can be used by controlling the etching agent spraying time.

For example, the clad plate 16 may be formed by the first layer 15*a* made of stainless steel or aluminum and the second layer 15*b* made of titanium. In this case, if a ferric chloride ($FeCl_3$) etching agent is used, only the first layer 15*a* is etched. As a result, each pressure chamber 18 is formed, with high precision, to have a width equal to the width of the associated open portion of the resist 50 and a depth equal to the thickness of the first layer 15*a*. If hydrofluoric acid (HF) is used for the second layer 15*b*, only the second layer 15*b* is etched. As a result, each communicating hole 34, 35 is formed, with high precision, to have a width equal to the width of the associated open portion of the resist 51 and a depth equal to the thickness of the second layer 15*b*.

Alternatively, the clad plate 16 may be formed by the first layer 15*a* made of nickel and the second layer 15*b* made of titanium. In this case, if an etching agent composed of ferric chloride ($FeCl_3$) and hydrochloric acid (HCl) is used, only the first layer 15*a* is etched and the pressure chambers 18 are formed with high precision in depth. If hydrofluoric acid (HF) is used for the second layer 15*b*, only the second layer 15*b* is etched and the communicating holes 34, 35 are formed with high precision in depth.

The materials of the first and second layers 15*a*, 15*b* may be interchanged. In such a case, etching agents should be selected according to the materials of the first and second layers 15*a*, 15*b* such that only either of the layers is etched. Further, the first and second layers 15*a*, 15*b* may be made of other materials than those described above. In such a case, etching agents that are able to substantially etch only either of the layers should be used to form the pressure chambers 18 and the communicating holes 34, 35 in the first and second layers 15*a*, 15*b*, respectively.

In the ink-jet head 30 according to the first embodiment, the cavity plate 15 includes the clad plate 16 formed by the first and second layers 15*a*, 15*b* made of different materials, and each of the first and second layers 15*a*, 15*b* is etched using an etching agent able to etch only either of the layers 15*a*, 15*b*, that is the two layers 15*a* and 15*b* are selectively etchable with respect to each other. If certain positional and dimensional conditions of the pressure chambers 18 and the communicating holes 34, 35 are satisfied as described above, the first and second layers 15*a*, 15*b* are etched using an etching agent which is able to etch both of the layers 15*a*, 15*b*. As a result, the pressure chambers 18 are formed in the first layer 15*a* and the communicating holes 34, 35 are formed in the second layer 15*b* with high precision in depth. Further, the use of the clad plate 16 ensures that the cavity plate 15 has a predetermined thickness. Thus, the cavity plate 15 is prevented from bending or buckling during the manufacturing process of the ink-jet head 30, and its manufacturing yield can be improved.

Figure 5:
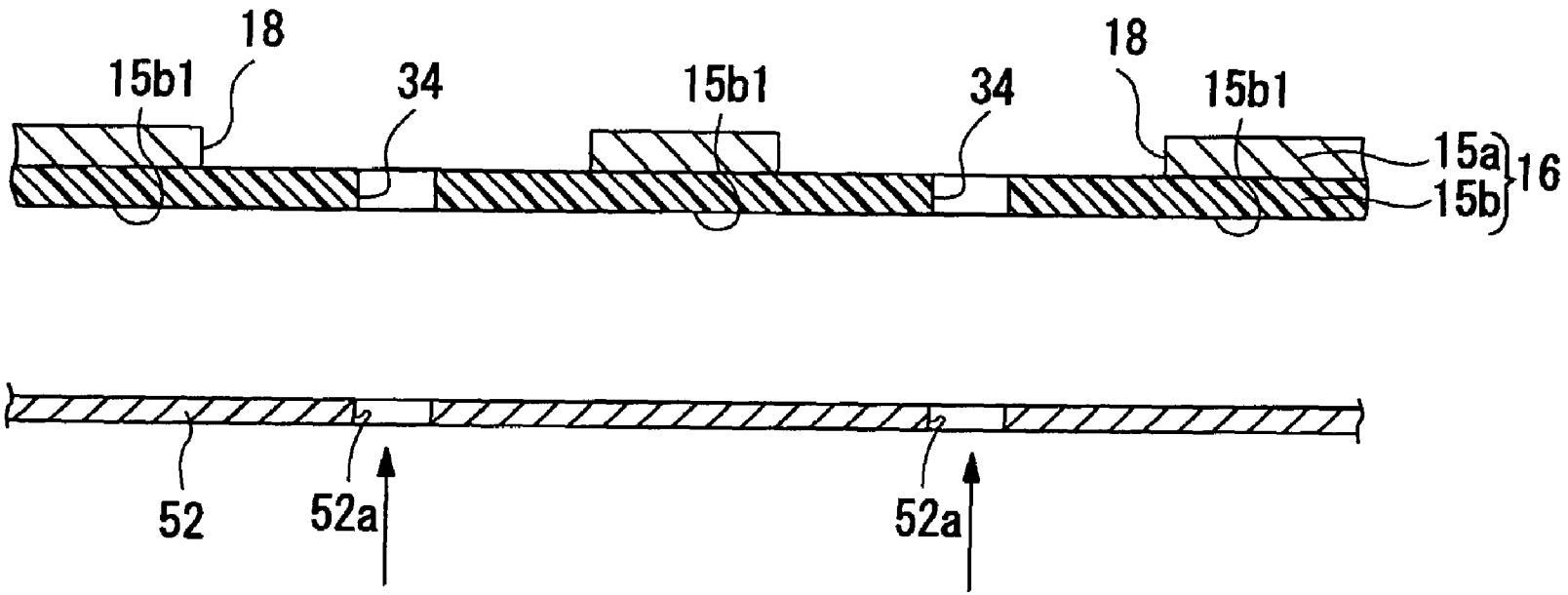
FIG. 5 is a cross-sectional view showing a laser irradiation process to form communicating holes in the second layer of the clad plate.

Although, in the above-described first embodiment, the clad plate 16 is formed by the first and second layers 15*a*, 15*b*, both made of metal, the clad plate 16 may be formed by the first layer 15*a* made of metal and the second layer 15*b* made of resin. For example, as shown in FIG. 5, the clad plate 16 may be formed by the first layer 15*a* made of metal, such as stainless steel, and a second layer 15*b* made of resin, such as polyimide. (The first layer 15*a* is first etched using an etching agent, as described above, to form the pressure chambers 18. Then, a mask 52 having laser transmitting portions 52*a* is placed below the second layer 15*b*, and laser light such as an Excimer laser is emitted upwardly toward the mask 52 in the directions of the arrows. As a result, the communicating holes 34 are formed in the second layer 15*b* to communicate with the associated pressure chambers 18.)

In this case, the first layer 15*a* is etched, as described above, using an etching agent that is able to etch substantially only the first layer 15*a*, except for the portions covered with a resist. As a result, the pressure chambers 18 are formed in the first layer 15*a*. Then, a mask 52 having laser transmitting portions 52*a* is placed below the second layer

15*b* bonded to the lower surface of the first layer 15*a*. Then, laser light, such as an Excimer laser, is applied to the mask 52 upwardly in the directions of the arrows. The laser light passes through the laser transmitting portions 52*a* of the mask 52 and, as a result, the communicating holes 34 are formed in the second layer 15*b*. The communicating holes 35 are formed in the second layer 15*b* in the same manner as for forming the communicating holes 34. Because the first and second layers 15*a*, 15*b* are treated separately by etching and laser irradiation, respectively, treatment for one layer does not affect the other layer. Thus, the pressure chambers 18 and the communicating holes 34, 35 are formed with high precision in depth (vertical dimension in FIG. 5). Further, by the use of the clad plate 16 having a predetermined thickness for the cavity plate 15, the cavity plate 15 becomes easy to handle during the manufacturing process of the ink-jet head 30, and thus its manufacturing yield can be improved.

Figure 6:
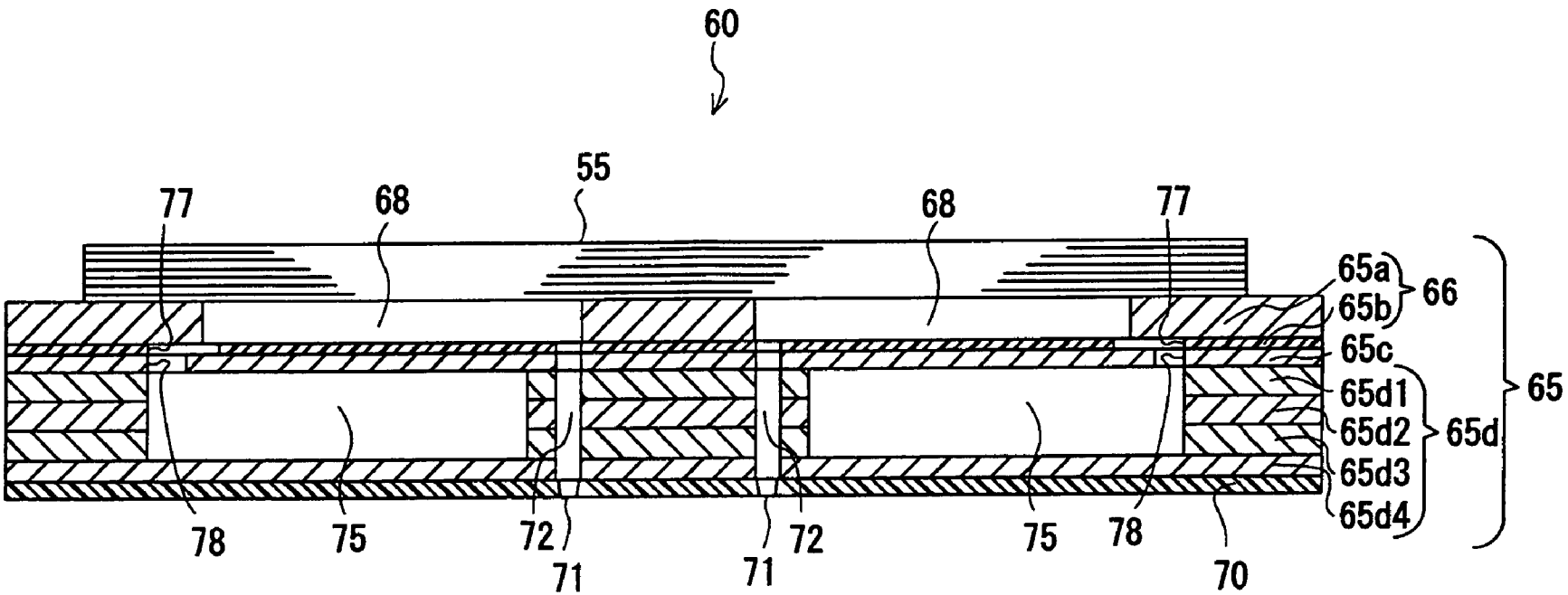
FIG. 6 is a cross-sectional view of an ink-jet head, according to a second embodiment of the invention, sectioned across pressure chambers substantially parallel to their longitudinal direction.
Figure 7:
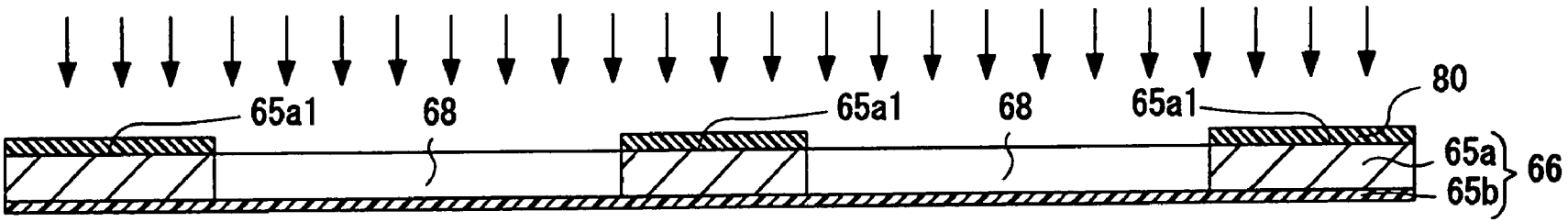
FIG. 7 is a cross-sectional view showing a process of forming pressure chambers in a first layer of a clad plate.
Figure 8:
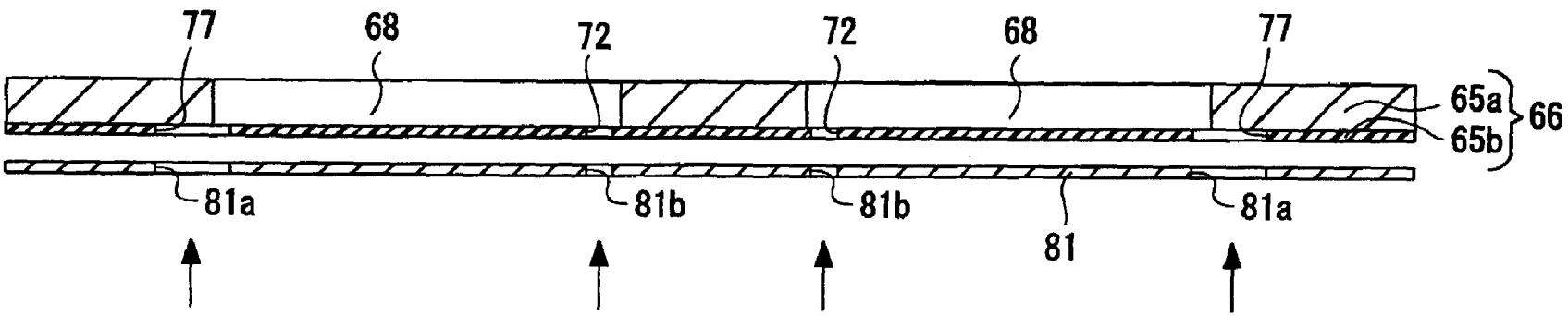
FIG. 8 is a cross-sectional view showing a process of forming communicating holes in a second layer of the clad plate.

FIG. 6 is a cross-sectional view showing an ink-jet head 60, according to a second embodiment of the invention, sectioned across pressure chambers substantially parallel to their longitudinal direction. FIG. 7 is a cross-sectional view showing a process of forming pressure chambers 68 in a first layer 65*a* of a cavity plate 65. FIG. 8 is a cross-sectional view showing a process of forming through-holes 77 in a second layer 65*b* of the cavity plate 65. As shown in FIG. 6, the ink-jet head 60 is formed by stacking an actuator plate 55, the cavity plate 65, and a nozzle plate 70. The actuator plate 55 has the same structure as the actuator plate 5 of the ink-jet head 30 according to the first embodiment. The nozzle plate 70 is a thin resin plate having a predetermined thickness.

The cavity plate 65 is a laminated plate formed by vertically laminating a plurality of layers. Among the laminated layers, the first and second layers 65*a*, 65*b* are unitarily bonded to form a clad plate 66. The first layer 65*a* is a thin plate made of metal, such as stainless steel, 42 alloy (nickel-based alloy), or nickel, while the second layer 65*b* is a thin plate made of resin, such as polyimide. The fist and second layers 65*a*, 65*b* have a thickness of about 20–80 μm, respectively, and thus the clad plate 66 has a thickness of about 40–160 μm. A spacer plate 65*c* is a thin metal plate. A manifold plate 65*d* is formed by laminating four thin metal plates 65*d*1–65*d*4 in this order from an upper position. The first layer 65*a* of the cavity plate 65, that is the uppermost layer of the cavity plate 65, has a plurality of arrays of pressure chambers formed across the plane of the first layer 65*a* by etching. For example, the first layer 65*a* has two arrays of pressure chambers. The second layer 65*b* has communicating holes 77 formed by laser irradiation, and the spacer plate 65*c* has ink supply holes 78 formed by etching.

The ink supply holes 78 in the spacer plate 65*c* are provided outwardly from the pressure chambers 68 with respect to a plane direction in which the cavity plate 65 extends. The communicating holes 77 in the second layer 65*b* are formed between the first layer 65*a* and the spacer plate 65*c* and elongated in that plane direction, parallel to the longitudinal direction of the pressure chamber 68. Each communicating hole 77 communicates, at its one end, with the associated pressure chamber 68 and, at its other end, with the associated lower ink supply hole 78. In other words, each communicating hole 77 is formed as a restrictor passage having a smaller sectional area with respect to the flow of ink than the associated pressure chamber 68 and ink supply hole 78, thereby preventing backflow of ink from the pressure chamber 68 to the ink supply hole 78.

The nozzle plate 70 at the bottom has a plurality of ink ejecting nozzles 71. The second layer 65*b*, the spacer plate 65*c*, and the manifold plate 65*d*, which are sandwiched between the first layer 65*a* and the nozzle plate 70, has communicating holes 72. Each pressure chamber 68 communicates, at its one end, with the associated nozzle 71 through the associated communicating holes 72. Additionally, the upper three thin plates 65*d*1–65*d*3 of the manifold plate 65*d* have manifold passages 75, each extending below and along an array of pressure chambers 68. Each pressure chamber 68 communicates, at its other end, with the associated manifold passage 75 through the associated communicating holes 77, 78 formed in the second layer and the spacer plate 65*c*, respectively.

Referring now to FIGS. 7 and 8, a method of forming the pressure chambers 68 and the communicating holes 77, 72 in the first and second layers 65*a*, 65*b* of the clad plate 66, respectively, will be described. As shown in FIGS. 7 and 8, the first layer 65*a* of the clad plate 66 is etched, except for a portion covered with a resist 80, using an etching agent that is able to etch substantially only the first layer 65*a*. In other words, the first layer 65*a* is selectively etchable relative to the second layer 65*b*. The pressure chambers 68 are formed in the first layer 65*a* in the same manner in which the pressure chambers 18 are formed in the clad plate 16 in the first embodiment. Then, a mask 81 with laser transmitting portions 81*a*, 81*b* is placed below the lower surface of the second layer 65*b* bonded to the lower surface of the first layer 65*a*, and laser light is emitted upwardly toward the mask 81 in the directions of the arrows. The laser light passes through the laser transmitting portions 81*a*, 81*b* of the mask 81 and, as a result, the communicating holes 77, 72 are formed, respectively in the second layer 65*b*.

In contrast, by a conventional method, grooves corresponding to the communicating holes 77 are formed by half-etching in the first layer 65*a* or the spacer plate 65*c* without providing the second layer 65*b* between the first layer 65*a* and the spacer plate 65C. The resultant grooves become uneven in depth (vertical dimension in FIG. 8) and less precise in sectional area. In the second embodiment, however, the first layer 65 formed by a thin metal plate and the second layer 65*b* formed by a thin resin plate are treated separately by etching and laser irradiation, respectively. Thus, each pressure chamber 68 is formed, with high precision, to have a width equal to the width of the associated open portion of the resist 50 and a depth equal to the thickness of the first layer 65*a*. Each through-hole 77 is formed, with high precision, to have a width equal to the width of the associated open portion of the mask 81 and to have a depth equal to the thickness of the second layer 65*b*. Consequently, the communicating holes 77 become precise in sectional area, and variations in flow resistance generated between the pressure chambers 68 and the ink supply holes 78 are reduced. Thus, the ink ejection performance is made uniform across the pressure chambers 68. The clad plate 66, the spacer plate 65*c*, the thin plates 65*d*1–65*d*4 forming the manifold plate 65, and the nozzle plate 70 are bonded to each other using a thermosetting adhesive.

Figure 9:
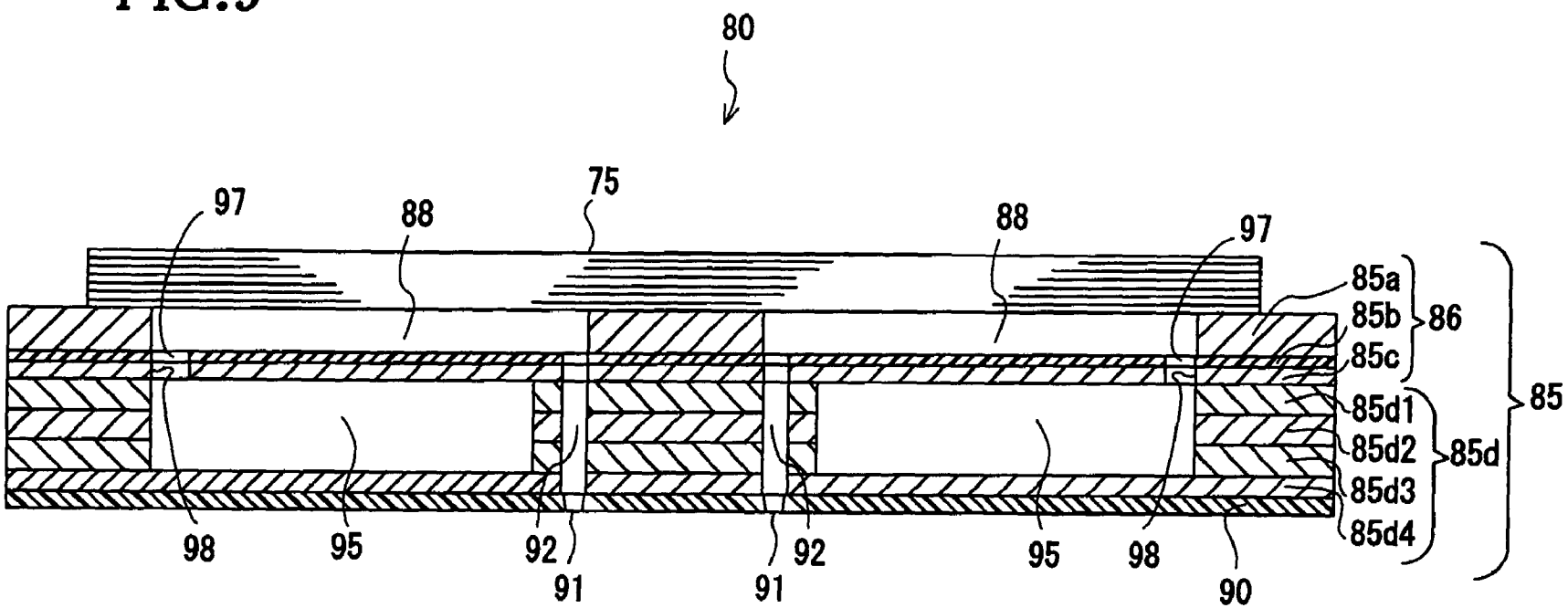
FIG. 9 is a cross-sectional view of an ink-jet head, according to a third embodiment of the invention, sectioned across pressure chambers substantially parallel to their longitudinal direction.
Figure 10:
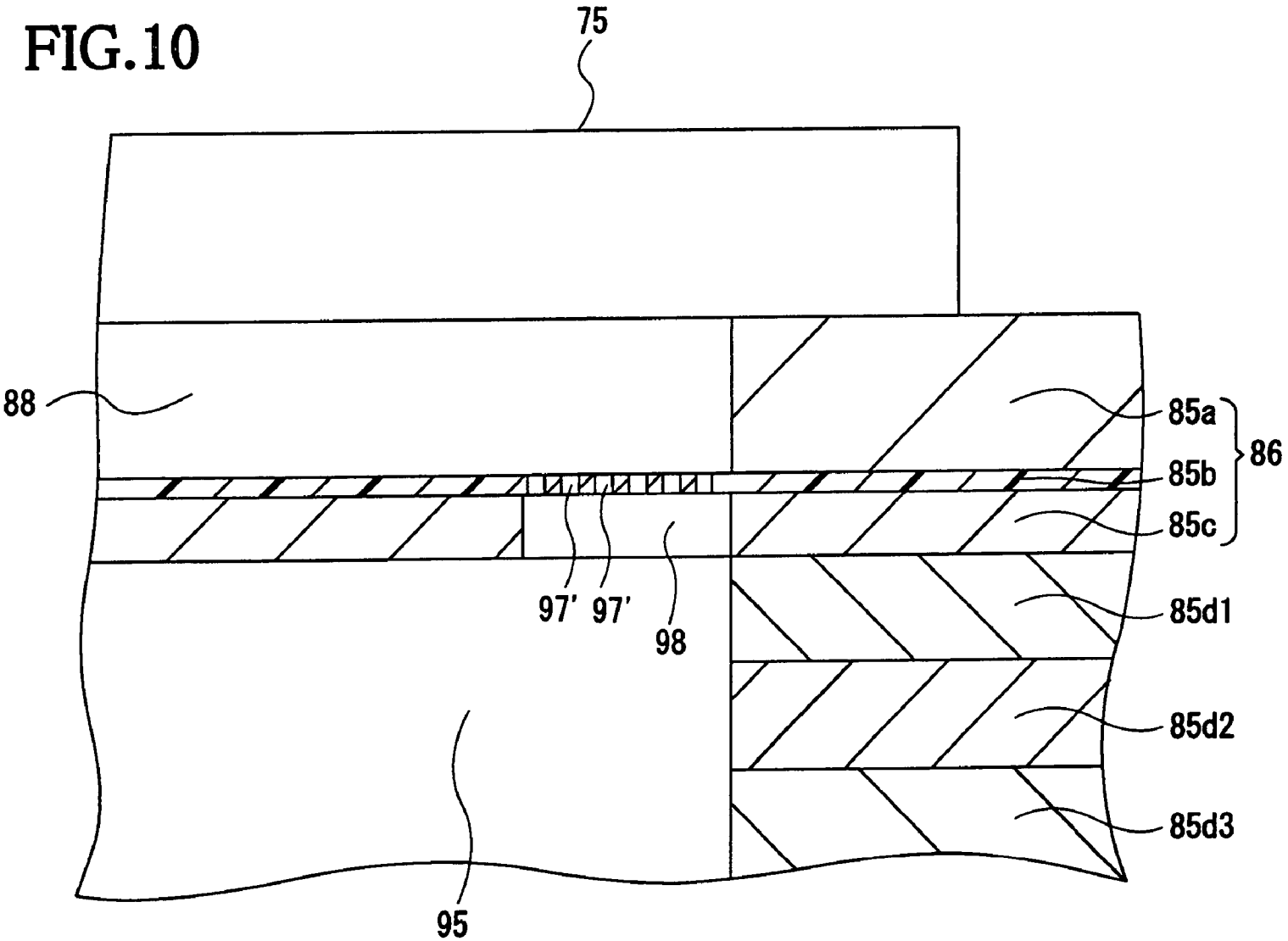
FIG. 10 is a partial enlarged cross-sectional view of communicating holes formed in a second layer of a clad plate.
Figure 11:
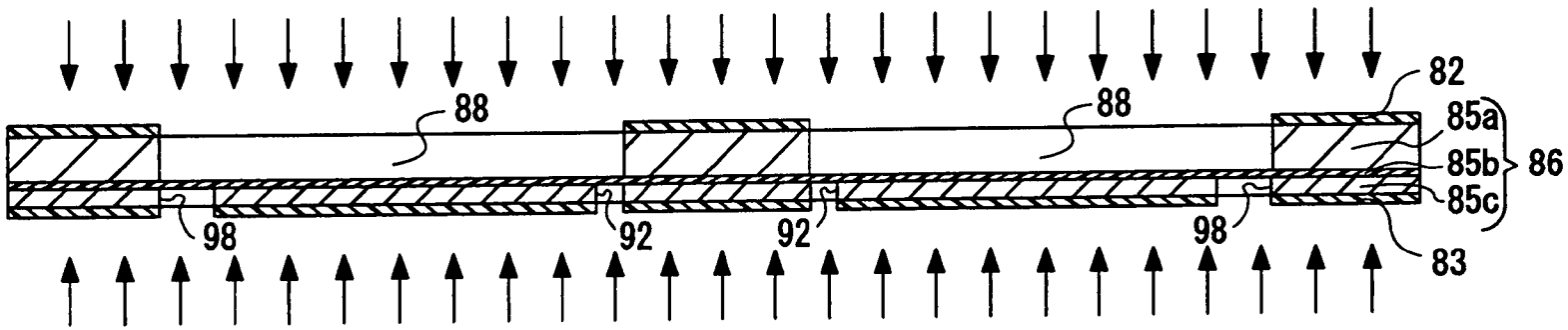
FIG. 11 is a cross-sectional view showing an etching process to form pressure chambers and communicating holes in first and third layers of the clad plate, respectively.
Figure 12:
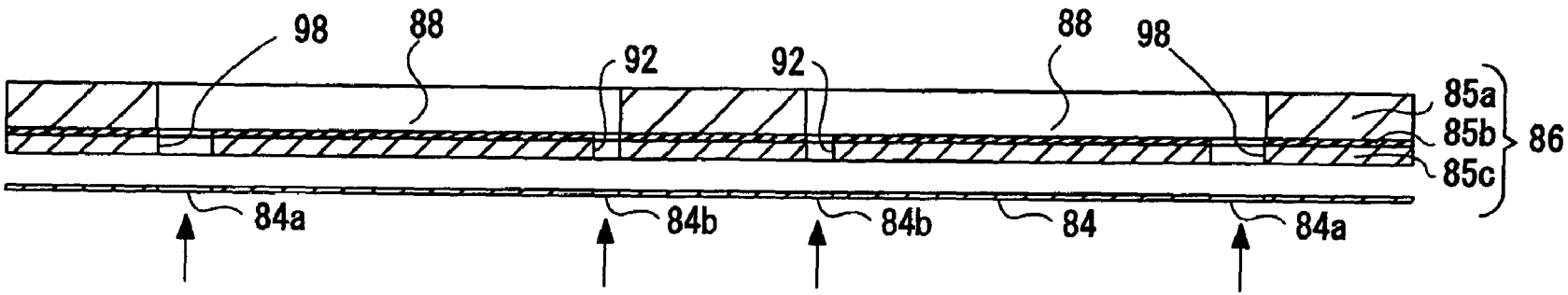
FIG. 12 is a cross-sectional view showing a laser irradiation process to form communicating holes in a second layer of the clad plate.
Figure 13:
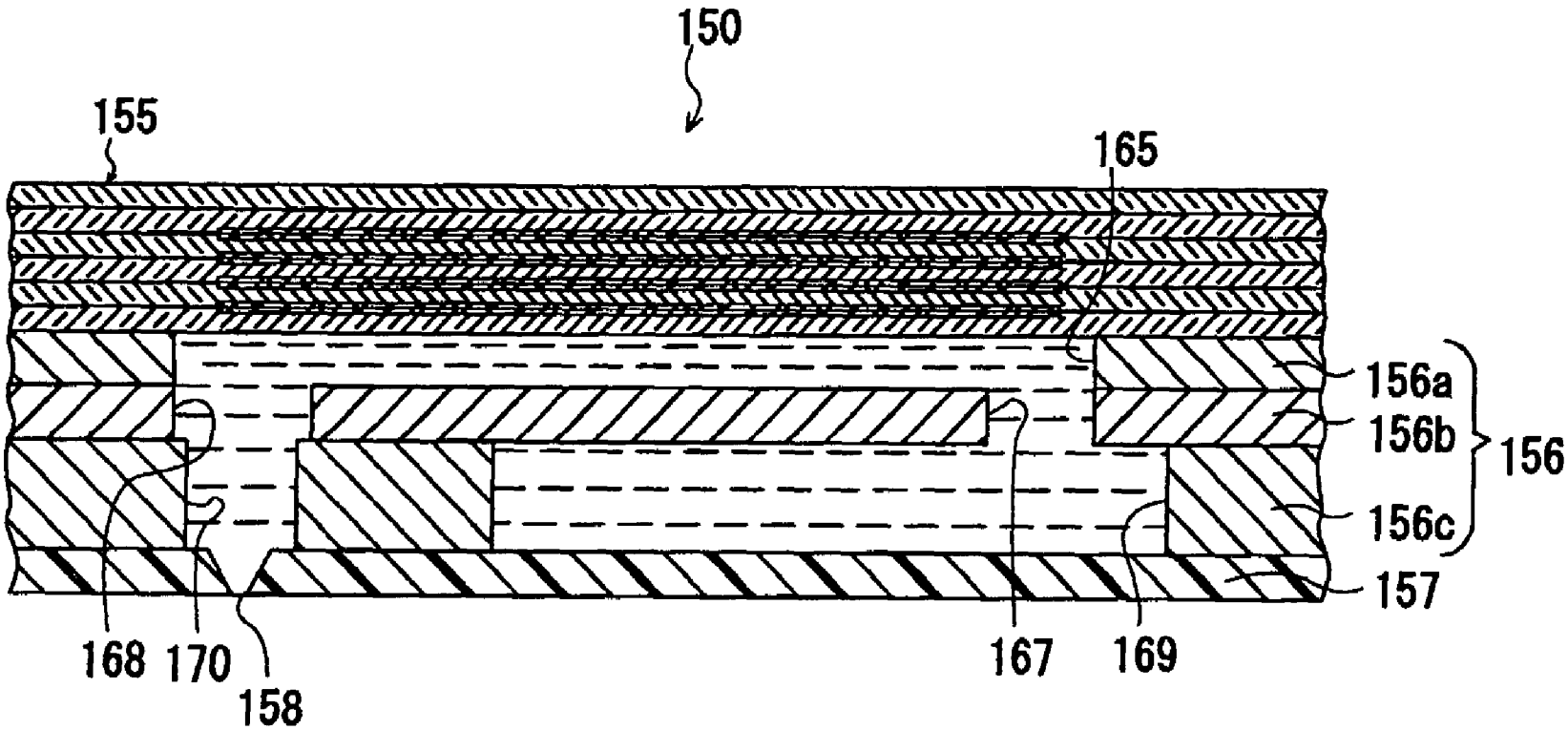
FIG.13 RELATED ART
FIG. 13 is a cross-sectional view of a prior-art ink-jet head.
Figure 14:
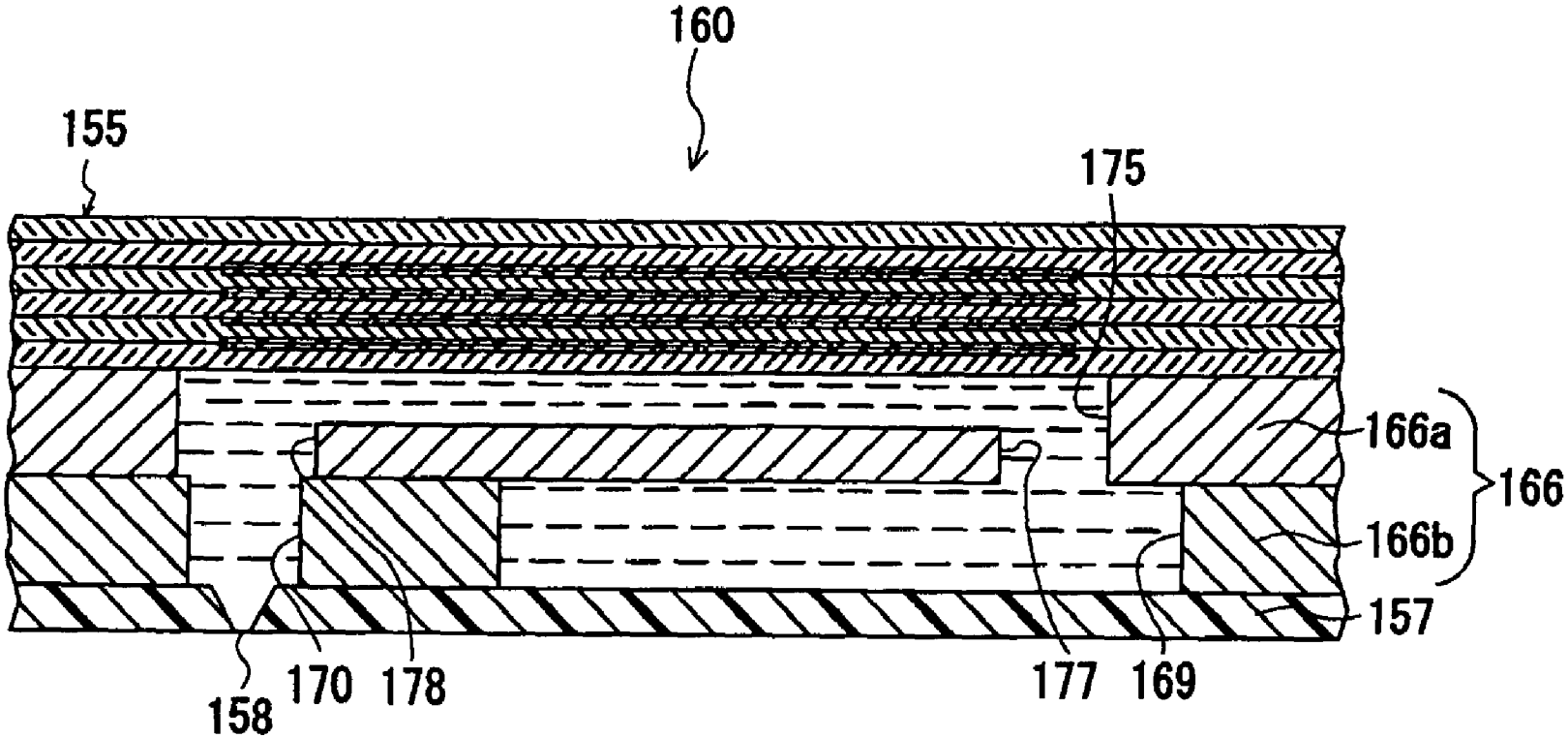
FIG.14 RELATED ART
FIG. 14 is a cross-sectional view of another prior-art ink-jet head.

Instead of the clad plate 66 formed by a thin metal plate and a thin resin plate in the second embodiment, a three-layer clad plate, formed by bonding one more thin metal plate to a thin resin plate of the clad plate 66, may be used to partially form a cavity plate. Referring now to FIGS. 9–12, an ink-jet head 80 according to a third embodiment of the invention and having a cavity plate 85 including a three-layer clad plate 86 will be described. FIG. 9 is a cross-sectional view of the ink-jet head 80 sectioned across pressure chambers substantially parallel to their longitudinal direction. FIG. 10 is a partial enlarged cross-sectional view of communicating holes 97 formed in a second layer of the clad plate 86 of FIG. 9. FIG. 11 is a cross-sectional view showing an etching process to form pressure chambers 88 and ink supply holes 98 in first and third layers 85*a*, 85*c*, respectively. FIG. 12 is a cross-sectional view showing a laser irradiation process to form communicating holes 97 in the second layer 85*b* of the clad plate 86.

As shown in FIG. 9, the ink-jet head 80 has a structure similar to the ink-jet head 60 in the second embodiment and includes an actuator plate 75, a nozzle plate 90 formed by a thin resin plate, and a cavity plate 85 formed by laminating a plurality of thin plates. A first layer 85*a* of the cavity plate 85 is a thin plate made of metal, such as stainless steel, 42 alloy (nickel-based alloy), or nickel, a second layer 85*b* is a thin plate made of resin, such as polyimide, and a third layer 85*c* is a thin plate made of metal, such as stainless steel, 42 alloy (nickel-based alloy), or nickel. A manifold plate 85d is formed by laminating four thin metal plates 85*d*1–85*d*4 in this order from an upper position. The first, second, and third layers 85*a*, 85*b*, 85*c* are unitarily bonded to form the three-layer clad plate 86. The first, second, and third layers 85*a*, 85*b*, 85*c* have a thickness of about 20–80 μm, 10–50 μm, and 20–120 μm, respectively, and thus the clad plate 86 has a thickness of about 50–250 μm.

The first layer 85*a* of the clad plate 86 has a plurality of arrays of pressure chambers 88 formed across the plane of the first layer 85*a* by etching. For example, the first layer 85*a* has two arrays of pressure chambers 88. The third layer 85*c* has ink supply holes 98 formed by etching and, through the ink supply holes 98, manifold passages 95 to be described later communicate with the associated pressure chambers 88. The second layer 85*b* has communicating holes 97 formed by laser irradiation. Each communicating hole 97 includes a plurality of small holes 97' (FIG. 10) arranged close to each other and serves as a filter preventing entry of dirt to the associated pressure chamber 88 from the outside.

The nozzle plate 90 at the bottom has a plurality of ink ejecting nozzles 91. The second layer 85*b*, third layer 85*c*, and manifold plate 85*d* have communicating holes 92. Each pressure chamber 88 communicates, at its one end, with the associated nozzle 91 through the associated communicating holes 92. Additionally, the upper three thin plates 85*d*1–85*d*3 of the manifold plate 85*d* have manifold passages 95, each extending below and along an array of pressure chambers 88. Each pressure chamber 88 communicates, at its other end, with the associated manifold passage 95 through the associated communicating hole 97 and through-hole 98 formed in the second and third layers 85*b*, 85*c*, respectively.

Referring now to FIGS. 11 and 12, a method of forming the pressure chambers 88, communicating holes 92, 97, and ink supply holes 98 in the three layers 85*a*–85*c* of the clad plate 86 of the cavity plate 85 will be described. As shown in FIG. 11, resists 82, 83 are formed first on the upper surface of the first layer 85*a* and the lower surface of the third layer 85*c*, respectively. Then, the first and third layers 85*a*, 85*c* are etched at the same time by spraying a suitable etching agent downwardly and upwardly, respectively, as shown by the arrows. At this time, the second layer 85*b* formed by a thin resin plate is not affected by the etching of the first and third layers 85*a*, 85*c*. Each of the first and third layers 85*a*, 85*c* is etched using an etching agent that is able to etch only itself, that is the layers 85*a*, 85*c* are selectively etchable with respect to the second layer 85*b*. As a result, the pressure chambers 88 are formed in the first layer 85*a*, and the ink supply holes 98 and the communicating holes 92 are formed in the third layer 85*c*.

Then, as shown in FIG. 12, a mask 84 with laser transmitting portions 84*a* is placed below the lower surface of the second layer 85*b*, and laser light is emitted upwardly toward the mask 84 in the directions of the arrows. The laser light passes through the laser transmitting portions 84*a*, 84*b* of the mask 84 and, as a result, the communicating holes 97, 92 are formed respectively in the second layer 85*b*. Each laser transmitting portion 84*a* is formed with a plurality of small through-holes (not shown), and the laser light passes through the small through-holes, thereby forming the communicating holes 97 (FIG. 9), each having a plurality of small holes 97' (FIG. 10) serving as filtering holes.

In the ink-jet head 80 according to the third embodiment of the invention, the three-layer clad plate 86 is used for the cavity plate 85. Two thin metal plates of the clad plate 86 are etched separately to form the pressure chambers 88 in one plate and the ink supply holes 98 in the other plate, and one thin resin plate of the clad plate 86 is irradiated with the laser light to form therein the communicating holes 97. As a result, the pressure chambers 88, ink supply holes 98, and communicating holes 97 are formed with high precision in depth.

In addition, each of the communicating holes 97 provided for the pressure chambers 88 includes a plurality of small holes arranged close to each other. Thus, the communicating holes 97 serve as filters that prevent entry of foreign objects into the pressure chambers 88 and nozzles 91 and prevent clogging thereof. Such a structure will obviate the need, in a conventional method, for bonding a filter with filtering holes, as a separate small component, to a cavity plate, and eliminate a positional shift of the filter when bonded.

In the ink-jet head according to the above-described embodiments of the invention, pressure chambers and communicating holes to the pressure chambers are formed in a cavity plate having a clad plate. The clad plate is formed to a predetermined thickness by bonding at least two layers made of different materials. Thus, the cavity plate has an enhanced rigidity and is easy-to-handle when manufactured into an ink-jet head.

When adjacent layers of the clad plate are made of different metals, each of the layers are etched to form therein either the pressure chambers or the communicating holes using an etching agent that is able to etch one of the layers and does not substantially affect the other. When one of the adjacent layers of the clad plate is made of metal and the other is made of resin, the metal layer is etched and the resin layer is irradiated with laser to form the pressure chambers or the communicating holes. In either case, the pressure chambers and the communicating holes are formed with high precision in depth, as compared with those formed by conventional half-etching.

When the pressure chambers and the communicating holes are highly precise in depth, they are also highly precise in sectional area, and the flow resistance generated between the pressure chambers and the ink supply holes are made uniform. Thus, stable ink ejection is accomplished in the ink-jet head.

Although the invention has been described with reference to specific embodiments, the description of the embodiments is illustrative only and is not to be construed as limiting the scope of the invention. Various other modifications and changes may be possible to those skilled in the art without departing from the spirit and scope of the invention.

What is claimed is:

1. A method of manufacturing an ink-jet head including an actuator plate driven by a drive voltage generated in a driving circuit and a cavity plate, the method comprising the steps of:

forming a clad plate of the cavity plate by unitarily bonding first and second layers made of different materials;

after the first and second layers are bonded, treating one of the first and second layers of the clad plate by etching using a first etching agent that is able to etch one of the first and second layers and substantially unable to etch the other to form either pressure chambers in the first layer or first holes in the second layer;

treating the other of the first and second layers of the clad plate to form the rest of the pressure chambers and the first holes such that each of the first holes communicates with an associated one of the pressure chambers; and laminating the first layer of the clad plate to the actuator plate.

2. The method according to claim 1, wherein the other of the first and second layers is treated by etching using a second etching agent that is able to etch the other of the first and second layers to form the rest of the pressure chambers and the first holes.

3. The method according to claim 2, wherein the one of the first and second layers is made of stainless steel or aluminum while the other is made of titanium, and the first etching agent is ferric chloride ($FeCl_3$) while the second etching agent is hydrofluoric acid (HF).

4. The method according to claim 2, wherein the one of the first and second layers is made of nickel while the other is made of titanium, and the first etching agent is an etching agent composed of ferric chloride ($FeCl_3$) and hydrochloric acid (HCl) while the second etching agent is hydrofluoric acid (HF).

5. The method according to claim 1, wherein the other of the first and second layers is made of resin and is treated with laser irradiation to form the rest of the pressure chambers and the first holes.

6. The method according to claim 5, wherein the resin is polyimide.

7. The method according to claim 1, further comprising a step of laminating a manifold plate having an ink supplying manifold passage to an opposite side of the second layer from the first layer such that the manifold passage communicates with the pressure chambers through the first holes.

8. The method according to claim 1, further comprising a step of forming second holes in the second layer by the same treatment that is used to form the first holes such that each of the second holes communicates with an associated one of the pressure chambers at an opposite end from an end where each of the first holes communicates with the associated one of the pressure chambers.

9. The method according to claim 8, further comprising a step of laminating a manifold plate having an ink supplying manifold passage and communicating holes to an opposite side of the second layer from the first layer such that the manifold passage communicates with the pressure chambers through the first holes and that each of the communicating holes communicates with an associated one of the second holes.

10. The method according to claim 9, further comprising a step of laminating a nozzle plate having ink ejecting nozzles to the manifold plate such that each of the nozzles communicates with an associated one of the second holes in the second layer through an associated one of the communicating holes in the manifold plate.

11. The method according to claim 1, wherein in the step of forming the clad plate, a third layer is unitarily bonded to an opposite side of the second layer from the first layer, and the method further comprises a step of treating the third layer by etching using a third etching agent that is able to etch the third layer and substantially unable to etch the second layer to form therein ink supply holes each communicating with an associated one of the pressure chambers through an associated one of the first holes in the second layer.

12. The method according to claim 11, wherein each of the first holes in the second layer includes a plurality of small holes arranged close to each other for an associated one of the pressure chambers.

13. The method according to claim 1, further comprising a step of preparing a spacer plate having ink supply holes to be associated with the first holes in the second layer, and a step of laminating the spacer plate to an opposite side of the second layer from the first layer such that the ink supply holes are provided outwardly from the pressure chambers with respect to a plane direction in which the first and second layers extend, and the first holes are elongated parallel to the plane direction between the first layer and the spacer plate.

14. The method according to claim 13, wherein the first holes have a smaller sectional area than the pressure chambers and the ink supply holes.

15. A method of manufacturing an ink-jet head including an actuator plate driven by a drive voltage and a cavity plate, the method comprising:

unitarily bonding first and second layers made of different materials to form a clad plate of a cavity plate;

after the first and second layers are bonded, etching one of the first and second layers using a first etching agent that is capable of selectively etching the one layer relative to the other layer to form either pressure chambers in the first layer or first holes in the second layer; and forming the pressure chambers or the first holes in the other layer such that each of the first holes in the second layer communicates with an associated one of the pressure chambers in the first layer.

16. The method according to claim 15, wherein the step of forming the pressure chambers or the first holes in the other layer includes etching the other layer using a second etching agent different from the first etching agent.

17. The method according to claim 16, wherein:

the one layer is made of stainless steel or aluminum while the other layer is made of titanium, and the first etching agent is ferric chloride ($FeCl_3$) while the second etching agent is hydrofluoric acid (HF); or the one layer is made of nickel while the other layer is made of titanium, and the first etching agent is composed of ferric chloride ($FeCl_3$) and hydrochloric acid (HCl) while the second etching agent is hydrofluoric acid (HF).

18. The method according to claim 15, wherein the other layer is made of resin, and the step of forming the pressure chambers or the first holes in the other layer includes treating the other layer with laser irradiation.

19. The method according to claim 18, wherein the resin is polyimide.

20. The method according to claim 15, wherein the step of forming the clad plate includes unitarily bonding a third layer to the second layer, and the method further comprises etching the third layer using a third etching agent that is capable of selectively etching the third layer relative to the second layer to form therein ink supply holes each communicating with an associated one of the pressure chambers through an associated one of the first holes in the second layer.

* * * * *